US007221107B2

(12) United States Patent
Melis

(10) Patent No.: US 7,221,107 B2
(45) Date of Patent: May 22, 2007

(54) LOW FREQUENCY ELECTRONIC BALLAST FOR GAS DISCHARGE LAMPS

(75) Inventor: Janos Melis, Miami, FL (US)

(73) Assignee: Ballastronic, Inc., Miami, FL (US)

( * ) Notice: Subject to any disclaimer, the term of this patent is extended or adjusted under 35 U.S.C. 154(b) by 0 days.

(21) Appl. No.: 11/105,155

(22) Filed: Apr. 13, 2005

(65) Prior Publication Data

US 2006/0232220 A1 Oct. 19, 2006

(51) Int. Cl.
*H05B 37/00* (2006.01)

(52) U.S. Cl. ..... 315/291; 315/209 R; 315/246

(58) Field of Classification Search ..... 315/291, 315/224, 225, 209 R, 219, 307, 246, 244, 315/276

See application file for complete search history.

(56) References Cited

U.S. PATENT DOCUMENTS 4,614,898 A 9/1986 Itani et al.
5,235,255 A 8/1993 Blom ..... 315/224
5,313,143 A 5/1994 Vila et al. ..... 315/209 R
5,428,268 A 6/1995 Melis et al. ..... 315/247
5,710,488 A 1/1998 Nilssen ..... 315/224
6,166,495 A 12/2000 Newell et al. ..... 315/291
6,329,761 B1 12/2001 Melis et al. ..... 315/209 R
7,009,347 B2 * 3/2006 Henze ..... 315/246

OTHER PUBLICATIONS

M.C. Unglert, The need for high-pressure sodium ballast classification, Lighting Design and Application, Mar. 1982.
J. Melis, An output unit for low frequency square wave electronic ballast, SOUTHEASTCON'94 (IEEE). 1994, Miami, Florida.

* cited by examiner

*Primary Examiner*—Wilson Lee

(57) ABSTRACT

An electronic ballast for high intensity gas discharge lamps where the wave form of the lamp current is square wave providing acoustic resonance and flickering free operation. The circuit, having high efficiency, operates in a wide temperature range providing ideal ballast curve and reliable ignition for the lamps. Furthermore, significant energy saving can be achieved by its externally controlled built in dimming capability.

9 Claims, 8 Drawing Sheets

LOW FREQUENCY ELECTRONIC BALLAST FOR GAS DISCHARGE LAMPS

CROSS-REFERENCE TO RELATED APPLICATION

Not Applicable

BACKGROUND OF THE INVENTION

The present invention relates to a low frequency power converter and specifically to low frequency electronic ballasts for gas discharge devices. More specifically, the present invention relates to a low frequency square wave electronic ballast for high intensity discharge (HID) lamps.

The prior art is replete with many known circuits providing electronic ballast for gas discharge lamps. For instance, high efficient electronic ballast which can be used with HPS (HID) lamps are discussed in U.S. Pat. No. 5,313,143 entitled "Master-slave half-bridge DC-to-AC switchmode power converter", and U.S. Pat. No. 6,329,761 entitled "Frequency controlled half-bridge inverter for variable loads", from the same inventor of the present invention. Furthermore, a low frequency square wave electronic ballast, especially for metal halide (MH) lamps are discussed in U.S. Pat. No. 5,428,268, entitled "Low frequency square wave electronic ballast for gas discharge devices", also from the same inventor of the present invention. The present invention has several basic differences if compared to the previously mentioned low frequency square wave ballast.

Introduction of a new solution for zero current sensing (which is an important functional part for both the input and current source units), a simple temperature compensated nonlinear function generator, the implementation logic supplies for the floating switches of the low frequency full-bridge inverter are among the main improvements and a more effective ignition solution. Further low frequency electronic ballast are discussed in U. S. Pat. No. 5,710,488 entitled "Low-frequency high-efficacy electronic ballast", from Nilssen, U.S. Pat. No. 4,614,898 entitled "electronic ballast with low frequency AC to AC converter" from Itani et al, 1986, U.S. Pat. No. 6,166,495 entitled "square wave ballast for mercury free arc lamp", from Newell et al, and U.S. Pat. No. 5,235,255 entitled "Switching circuit for operating a discharge lamp with constant power" from Blom. Still further advantages of the present invention comparing to mentioned patent applications will become apparent from a consideration of the ensuing description and drawings.

An important application for high frequency switchmode power converters is supplying power to gas discharge devices, especially high intensity discharge (HID) lamps. Therefore, the efficiency of the conventional core&coil ballast can be significantly improved and the weight decreased. In the case of high frequency powering of gas discharge lamps, the high frequency ballast and the gas discharge lamp have a higher level of interaction than that which exists between a conventional low frequency ballast and gas discharge lamp. High frequency ballasts, where the frequency of lamp current higher than 4 kHz, may suffer from acoustic resonance which can cause various problems such as instability, high output fluctuation, or, in the worst case, cracked arc tubes. Therefore, an optimum solution to this problem is the use of a high frequency DC-to-DC switch-mode converter as a controlled current source connected to a low frequency DC-to-AC square wave inverter supplying the gas discharge lamp. Due to its lessened weight, higher efficiency and the nonexistence of flickering and acoustic resonances, this novel high frequency ballast providing low frequency square wave current for the HID lamps, has significant advantages when compared with either the conventional low frequency ballasts and the usual high frequency electronic ballast. Additionally, a new, high sophisticated electronic ballast generation can be introduced to provide several special features, such as, for example, automatic or controlled dimming providing significant energy saving in a wide temperature range.

BRIEF SUMMARY OF THE INVENTION

It is an object of the present invention to provide an acoustic resonance and flickering free, high efficient low frequency square wave electronic ballast for high intensity gas discharge lamps operating in wide temperature range providing extended operational life time and energy saving.

A second object of the present invention to provide a dimmable electronic ballast for high intensity gas discharge lamps providing further energy saving.

A further object of the present invention to provide a high power factor input unit implementing a DC power supply for electronic ballast, wherein no electrolytic capacitors are used;

Another object of the present invention to provide a DC current source, wherein the output power can be externally controlled in a given range implementing dimming, wherein no electrolytic capacitors are used;

Further object of the present invention to provide a floating logic control circuit controlling a high frequency buck converter as a DC current source;

Another object of the present invention to provide a highly efficient square wave full-bridge inverter operating in a very wide frequency range including DC operation, wherein no electrolytic capacitors are used;

Further object of the present invention to provide a logic control circuit controlling a square wave full-bridge inverter implementing transition between the high (or zero) and the low frequency operations;

Another object of the present invention to provide a high frequency, high voltage ignition solution for reliable ignition of HID lamps.

Further object of the present invention to provide ideal ballast curve for HID lamps, wherein the lamp power is independent from the line voltage fluctuation and the lamp voltage increasing during the lamp life time;

These and other objects, features and advantages of the present invention will be more readily apparent from the following detailed description, wherein reference is made to the drawings.

BRIEF DESCRIPTION OF THE DRAWINGS

In the drawings, closely related figures have the same numbers but different alphabetic suffixes.

DETAILED DESCRIPTION OF THE INVENTION

Generally, the high frequency electronic ballasts have shown limitation factors which severely restrict the availability of commercial applications for the HID lighting industry. Due to the fact that acoustic resonance is produced in a variety of different frequency ranges, which ranges are themselves dependent upon the lamp characteristics. In other words, a high frequency electronic ballast will cause acoustic resonance in some HID lamps, but not in others. Naturally, this draw-back makes it impossible to market a universally acceptable electronic HID ballast which may be used with any lamp other than a lamp with which the ballast has been specifically tested, in order to ensure that their is no acoustic resonance.

Figure 1A:
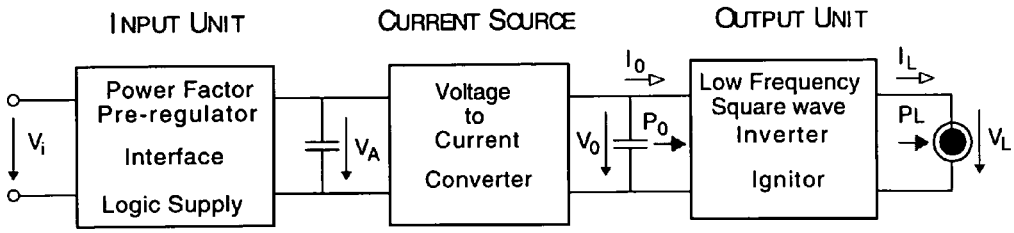
FIG. 1A illustrates the block diagram of preferred electronic ballast for gas discharge lamps.
Figure 1B:
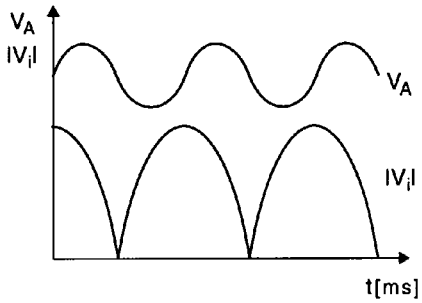
FIG. 1B shows the output voltage wave form of the Input Unit and the rectified input voltage
Figure 1C:
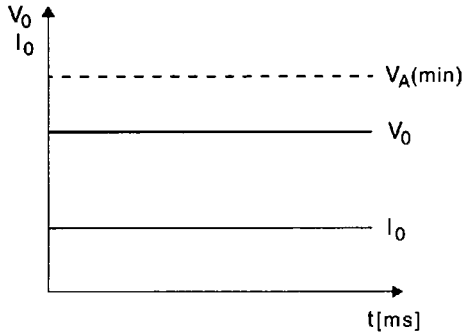
FIG. 1C illustrates the output voltage and current of the Current Source. It also shows the minimum level of its input voltage.
Figure 1D:
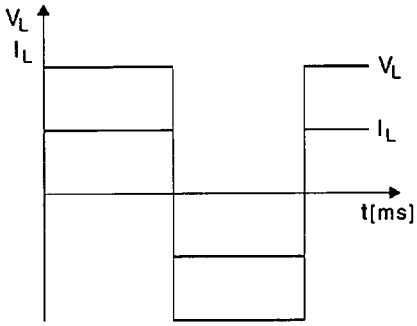
FIG. 1D shows the square wave lamp voltage and lamp current.
Figure 1E:
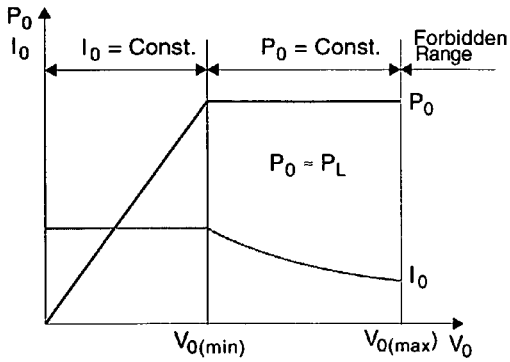
FIG. 1E illustrates the diagram of lamp current vs. lamp voltage and the preferred ballast curve

For overcoming the disadvantages of the high frequency electronic ballasts, an electronic ballast having high efficiency (≈95%) and low frequency square wave output current is suggested as illustrated in FIG. 1A including the main three units of the preferred low frequency square wave electronic ballast, namely:

an Input Unit, including a power factor preregulator, an interface circuit for external control, and logic supply providing stabilized 12V for the all control units of the ballast. The output voltage of the Input Unit (V1) and the rectified input voltage (Vi) are shown in FIG. 1B where the power factor Preregulator is based on a boost converter configuration;

a Current Source, which can be considered as a voltage to current converter implementing the ideal ballast curve shown in FIG. 1E. In this case, the current in low output voltage (0<20V) can be lowered, but it should be sufficiently high, forcing the transition from glow discharge to arc discharge at a certain glow discharge voltage determined by the lamp. FIG. 1C shows the output voltage and current levels determined by the lamp, if the current source is based on a buck converter configuration ($V_1>V_0$);

an Output Unit (full-bridge inverter), as a solution to the acoustic resonance problem caused by high frequency lamp current, low frequency (50 Hz-500 Hz) square wave lamp current is implemented as it is shown in FIG. 1D. In the case of a low frequency square wave lamp current, the temperature modulation of the central discharge channel is almost zero. However, since the polarity change of the lamp current is not instantaneous, especially if a low inductance ignitor transformer is connected in series with the lamp, the lamp power fluctuates twice of the current frequency. Since the transition is very fast (<10 μs) with respect to a half-period (5-10 ms), the flickering is negligible. Also, for the same reason, the high frequency harmonics of the lamp current are significantly smaller than in the high frequency case.

From electronic circuit viewpoint a square wave ballast is more complex than a simple high frequency inverter. It should contain at least two power unit, namely a power controlled current source and a low frequency full-bridge inverter. Furthermore, if high power factor is required, it should be also included a high power factor pre-regulator. Therefore, the increased complexity and higher cost of a low frequency square wave electronic ballast may restrict its industrial application to areas where special requirements are demanded, namely extremely wide temperature range and flickering free operation. Special circuit solutions for overcoming the technical barriers from ballast and electronic circuit viewpoints will be presented in the following detailed descriptions.

Input Unit

Figure 2A:
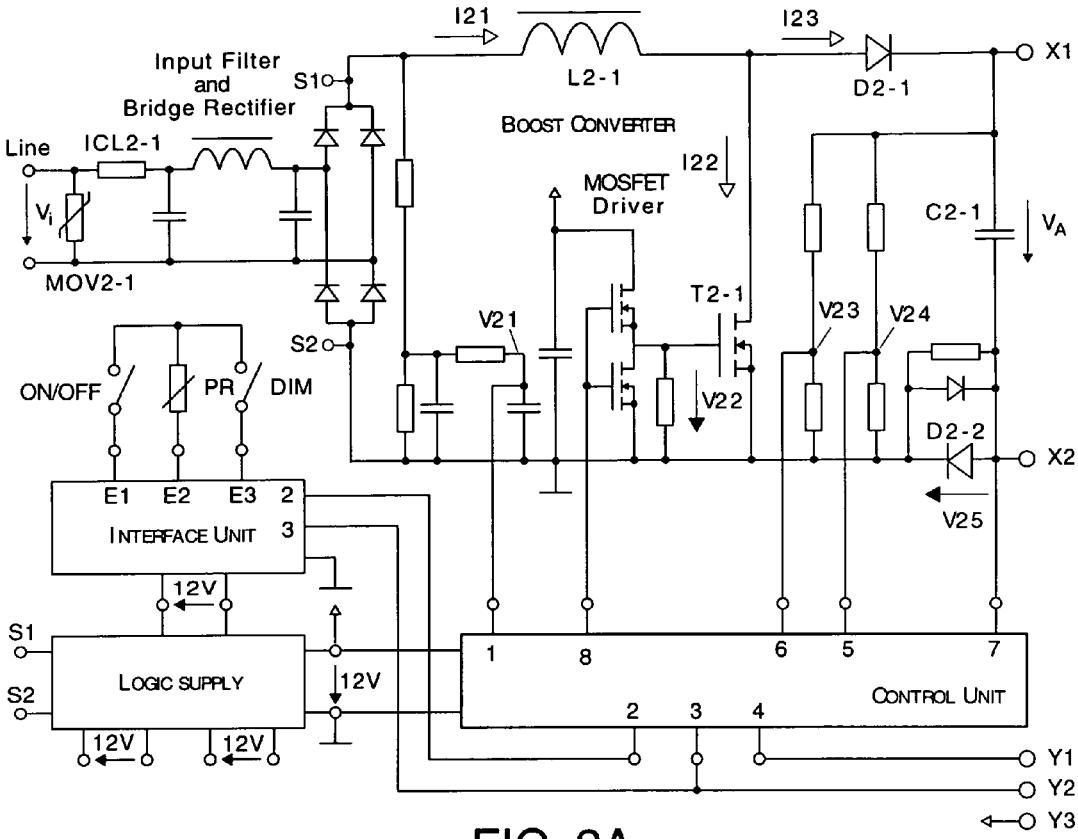
FIG. 2A shows the circuit diagram of the Input Unit and its Control Unit. It also shows the Interface Unit and the Logic Supply.

The overall efficiency and the cost of an electronic ballast device is crucial. Therefore, only a simple but very highly efficient (>97%) circuit solutions can be considered still providing high power factor and low total harmonic distortion. Since a simple rectifier and filter can produce large third harmonic distortion and the power factor is extremely low (<50%), application of a high power factor input unit (pre-regulator) is required. In this case the relative simplicity and very high efficiency can be considered as the main design goals. From industrial application viewpoint the very low THD (<3%) and the ideal power factor(100%) are not required. An acceptable compromise is: THD<10% and PF>97%. According to these requirement, as it is shown in FIG. 2A, a boost converter configuration in discontinuous border mode can be considered as the optimum solution even if the amplitude of the inductor current is higher then in continuous mode. In this case, the zero current switching, especially at higher voltages (200V-400V) dramatically decreases the stress of the switches, therefore increasing the reliability and efficiency of the overall circuit. In FIG. 2A the main components of boost converter—connected to the Input Filter—are the Inductor L2-1, MOSFET T2-1FIG, Rectifier D2-1, and Capacitor $V_A$. The DC voltage V21 is proportional to the average value of input voltage. Rectifier D2-2 provides zero current sensing when T2-1 is OFF. FIG. 2A also shows the Interface Unit providing isolated dimming and ON/OFF external control. Furthermore, a Logic Supply Unit providing stabilized 12V for the control units of the ballast is also illustrated in FIG. 2A.

Figure 2B:
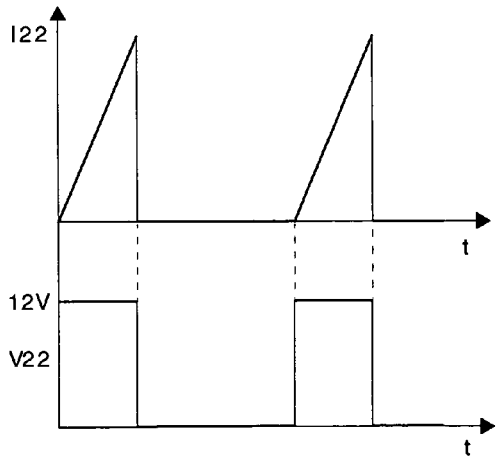
FIG. 2B illustrates the current wave form of the main switch T1 and its control signal.
Figure 2C:
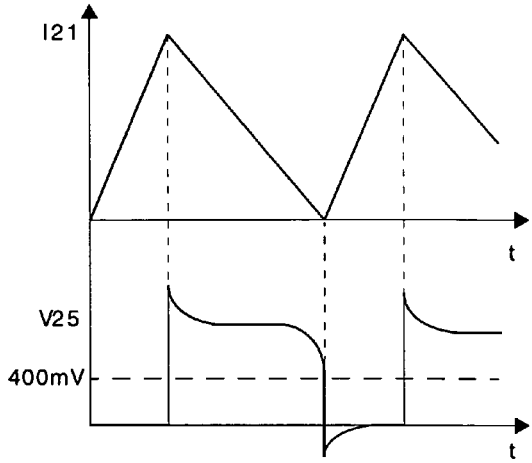
FIG. 2C shows the current and voltage wave forms of rectifier D2 shown in FIG. 2A.

FIG. 2B illustrates the current wave form of the main switch implemented by power MOSFET T2-1 and its gate control signal V22. FIG. 2C shows the inductor current I21 in the discontinuous border mode, and the voltage signal V25 on rectifier D2-2 providing a simple and effective (low power loss) solution for the zero current sensing of the inductor L, where no shunt resistor is applied. Therefore, using a simple comparator (see IC2-11 in FIG. 2E), the zero/nonzero values of the inductor current can be easily converted to digital signal. Controlled On-time and zero current switching on techniques are applied. Therefore, the peak and average inductor current is sinusoidal as is the input voltage. Furthermore the control of the circuit in discontinuous mode, based on the constant On Time method, can be easily implemented (no right plane zero) increasing the reliability and efficiency of the overall circuit.

Figure 2D:
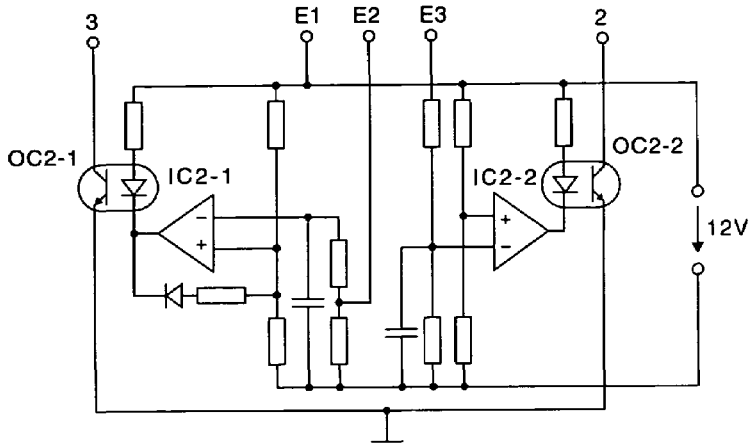
FIG. 2D shows the detailed circuit diagram of the Interface Unit, providing external dimming and ON/OFF control.

FIG. 2D shows the circuit diagram of the Interface Unit based on comparators IC2-1 and IC2-2. The whole Interface Unit is isolated from the main part of the ballast (therefore, from the line) and the control connection is implemented by optoisolators OC2-1 and OC2-2. The dimming(E1-E3) can be externally controlled by a simple low power switch (DIM) as it is shown in FIG. 2A. The ON/OFF control(E1-E2) can be also realized by a low power switch, or if it is required, with a photoconductive cell (PR).

Figure 2E:
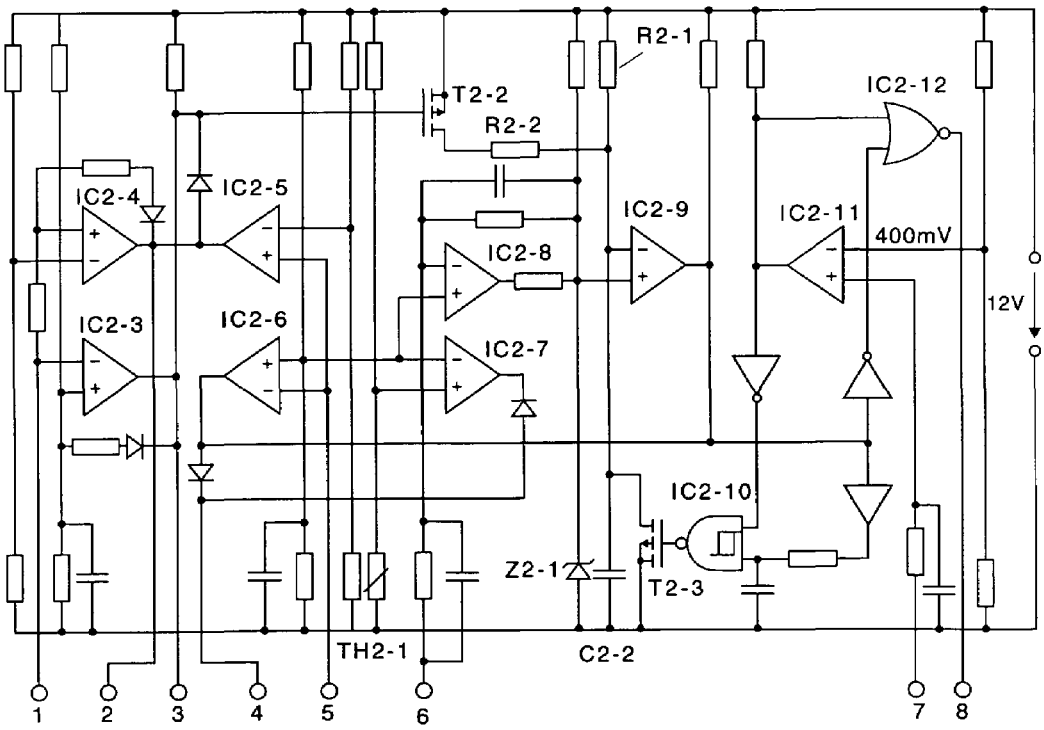
FIG. 2E illustrates the detailed circuit diagram of the Control Unit of the preferred Input Unit.

FIG. 2E shows the detailed circuit diagram of the preferred Control Unit of the Input Unit including:

(a) an error amplifier IC2-8 controlling the output voltage $V_A$;

(b) a sawtooth generator implemented by a resistor R2-1 (R2-1×R2-2 in case of dimming controlled by low power MOSFET T2-2), a capacitor C2-2, a low power MOSFET T2-3 and a NAND Schmitt-trigger IC2-10;

(c) an ON-time controller implemented by comparator IC2-9, where the inputs are connected to the sawtooth generator and the error amplifier IC2-8 where the maximum on-time is limited by Zener diode Z2-1;

(d) a zero current sensing comparator IC2-11 connected to the rectifier D2-2 and an approximately 4000 mV voltage source;

(e) the voltage comparators IC2-3 and IC2-4 are controlled by voltage V21 which is proportional to the average value of the rectified input voltage $V_i$, and voltage comparators IC2-5 and IC2-6 are controlled by the output voltage ($V_A$) of the boost converter;

(f) a temperature controller is implemented by voltage comparator IC2-7 controlled by thermistor TH2-1;

(g) a dual input NOR gate controlling the MOSFET Driver of T2-1 (FIG. 2A), where the inputs are connected to the zero current sensing comparator IC2-11 and the ON-time controller comparator IC2-9.

An essential difference between the preferred high power factor preregulator of the present invention and standard regulators, is the zero current sensing. In this case, the voltage drop on rectifier D2-2 is compared to the zero level of the control unit providing sensitivity and less loss. This solution is effective if the main switch (T2-1) is switched on at zero inductor current level as in the preferred embodiment. A further difference between the preferred high power factor preregulator and standard regulators, is the utilization in the present invention, of a relatively small value film capacitor (C2-1) instead of employing a large value electrolytic capacitor as the output capacitor. In the case, the fluctuation (120 Hz) of the output voltage $V_A$ is large as it is illustrated in FIG. 2B.

Current Source

Figure 3A:
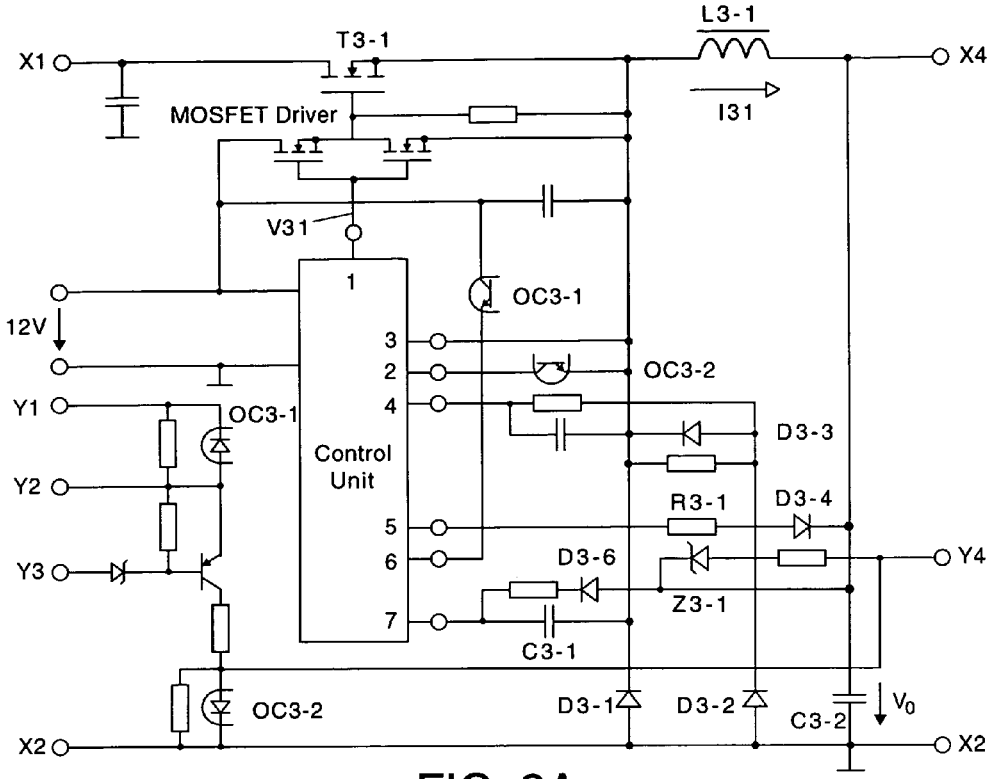
FIG. 3A illustrates the circuit diagram of the DC Current Source.
Figure 3B:
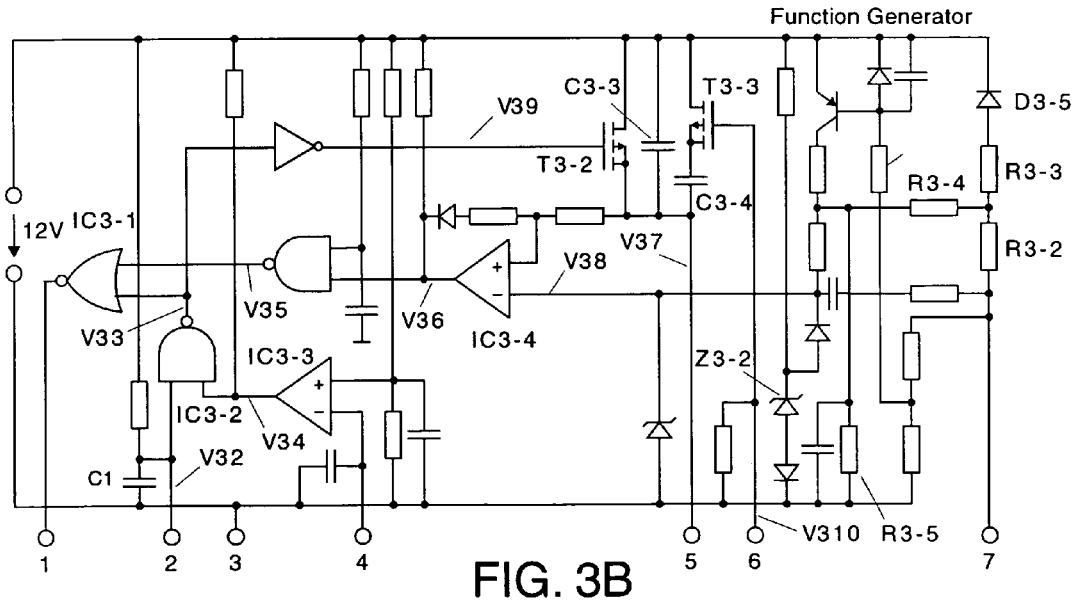
FIG. 3B shows the detailed circuit diagram of the Control Unit of the preferred DC Current Source shown in FIG. 3A.
Figure 3C:
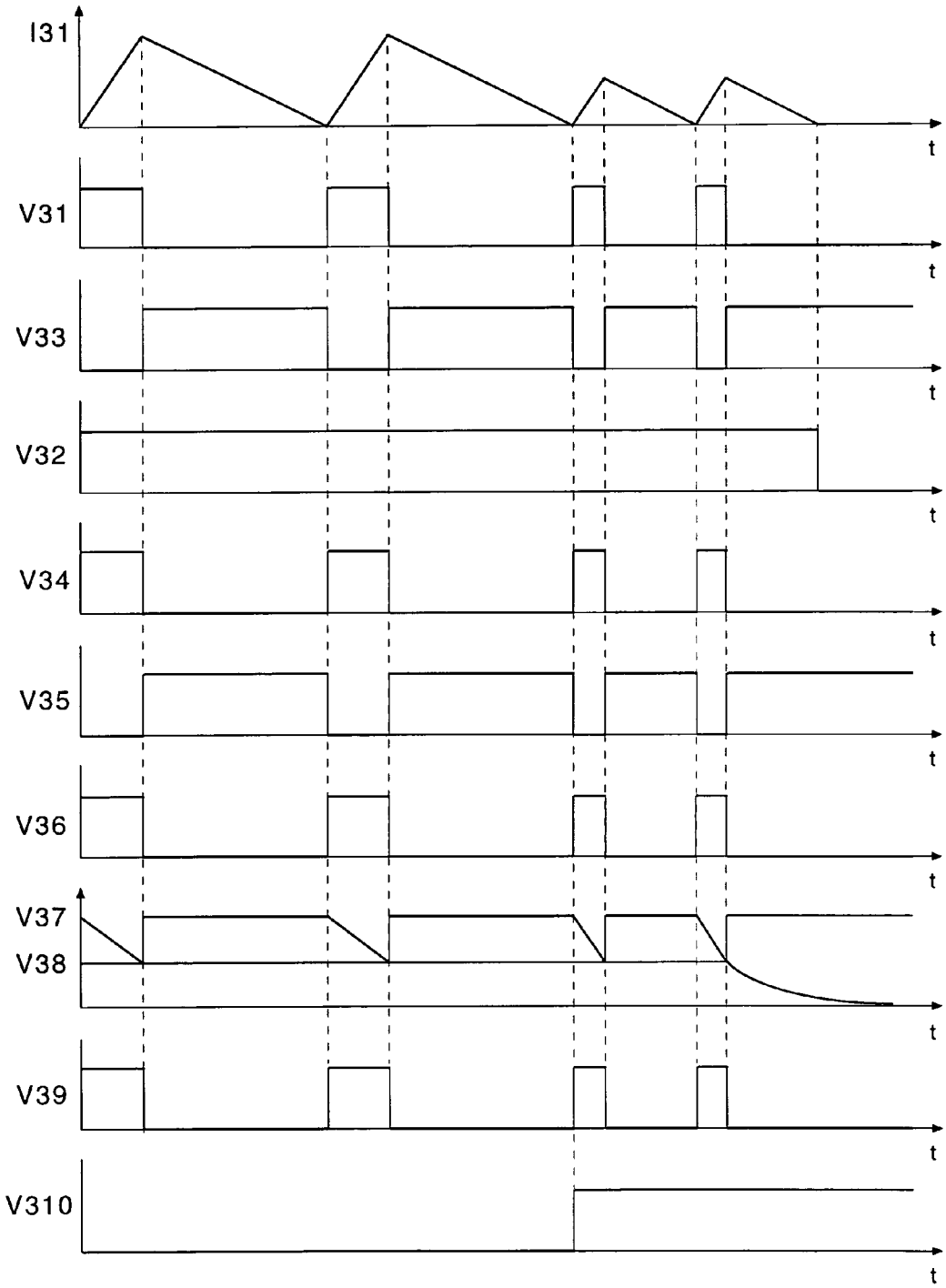
FIG. 3C shows the basic wave forms of the preferred DC Current Source and its Control Unit.

With the exception of boost derived converters, several converter configuration may applied as the current source. It can be seen that a basic buck converter as the current source of the low frequency square wave ballast may be an obvious choice, shown in FIG. 3A. Avoiding extra stress and loss in the switches (T3-1, D3-1), discontinuous border mode for the inductor current I31 is chosen as it is shown in FIG. 3C. In this case, the known stability problems of the continuous mode are avoided and a special control method can be applied as the preferred solution. FIG. 1E shows the required output power and current vs. output voltage characteristics as the ideal ballast curve for HPS (HID) lamps. The minimum and maximum output voltages are determined by the nominal lamp voltages (100V/55V for HPS, and 130V for MH lamps).

The applied control method is significantly different from the usual ones as it will demonstrated in the following part. The control unit, shown in FIG. 3A, is connected directly to the MOSFET—Driver and therefore to the main switch T3-1.

The zero current sensing of the inductor current I31 implemented by a fast rectifier D3-2 connected in series with a Schottky-rectifier D3-3 which rectifiers are connected in parallel with the main rectifier D3-1. If the main switch T3-1 is OFF, the main rectifier D3-1 is ON and an approximately 200 mV voltage drop occurs across the Schottky-rectifier D3-3. This voltage controls a voltage comparator IC3-3 (FIG. 3B) connected to an input of NAND Schmitt-trigger IC3-2, which forces T3-1 OFF, and allowing the ON state of the main switch T3-1 at zero inductor current.

The mapping of inductor current 131 in the ON state of the main switch T3-1 is implemented by rectifier D3-4 connected in series with resistor R3-1 providing charge current for capacitor C3-3. Therefore, the voltage (12-V37) is proportional to the inductor current I31, since both the inductor current and the capacitor voltage V37 depend linearly on the same voltage: $V_A$-$V_0$. Therefore, the peak inductor current as well as the average inductor current can be directly controlled by a reference voltage V38 (FIG. 3B). The discharge of the capacitor C3-3 is achieved by a low power p channel MOSFET T3-2 controlled by the zero current sensing voltage comparator IC3-3 shown in FIG. 3B.

The control of output power can be achieved by implementing the proportionality of the reference voltage V38 to the inverse value of output voltage $V_0$. Therefore, the control of the constant output power can be solved in a certain range of output voltage. Generally, for HID lamps, this output voltage range is: 80V-160V. Continuous dimming of the output power (lamp power) can be achieved by a continuous decrease of the value of resistor R3-1. The output power can be changed in discrete steps by the values of capacitor C3-3. FIG. 3B shows a solution for this case, where a second capacitor C3-4 is connected parallel with C3-3 controlled by a low power MOSFET T3-3 via an optocoupler OC3-2 providing isolation. Actually, in this case, the full power is provided when MOSFET T3-3 is ON, and dimmed operation if MOSFET T3-3 is OFF. Dimming can be advantageous from an energy saving consideration if the decreased light level is acceptable in certain situations.

The electronic realization of the required inverse relationship is implemented by a nonlinear Function Generator shown in FIG. 3B, based on resistors R3-2, R3-3, R3-4, R3-5, and diode D3-4. The output voltage $V_0$ boosted to the floating control level by rectifier D3-6 and a smoothing capacitor C3-1 as it shown in FIG. 3A providing the appropriate voltage level for the function generator.

The voltage comparator IC3-4 controls the ON time of the main switch T3-1. The dual input NOR gate IC3-1 is controlled by the voltages V33 (V32 and V34) and V35 (V36), and its output is connected to the MOSFET Driver shown in FIG. 3A.

The output voltage $V_0$ is limited by applying a Zener diode Z3-1 connected in series with the optocoupler OC3-2 providing OFF-state for the main switch T3-1. The corresponding signal wave forms of the circuit diagrams of figures FIG. 3 A and FIG. 3 B are illustrated in FIG. 3C.

Output Unit

Figure 4A:
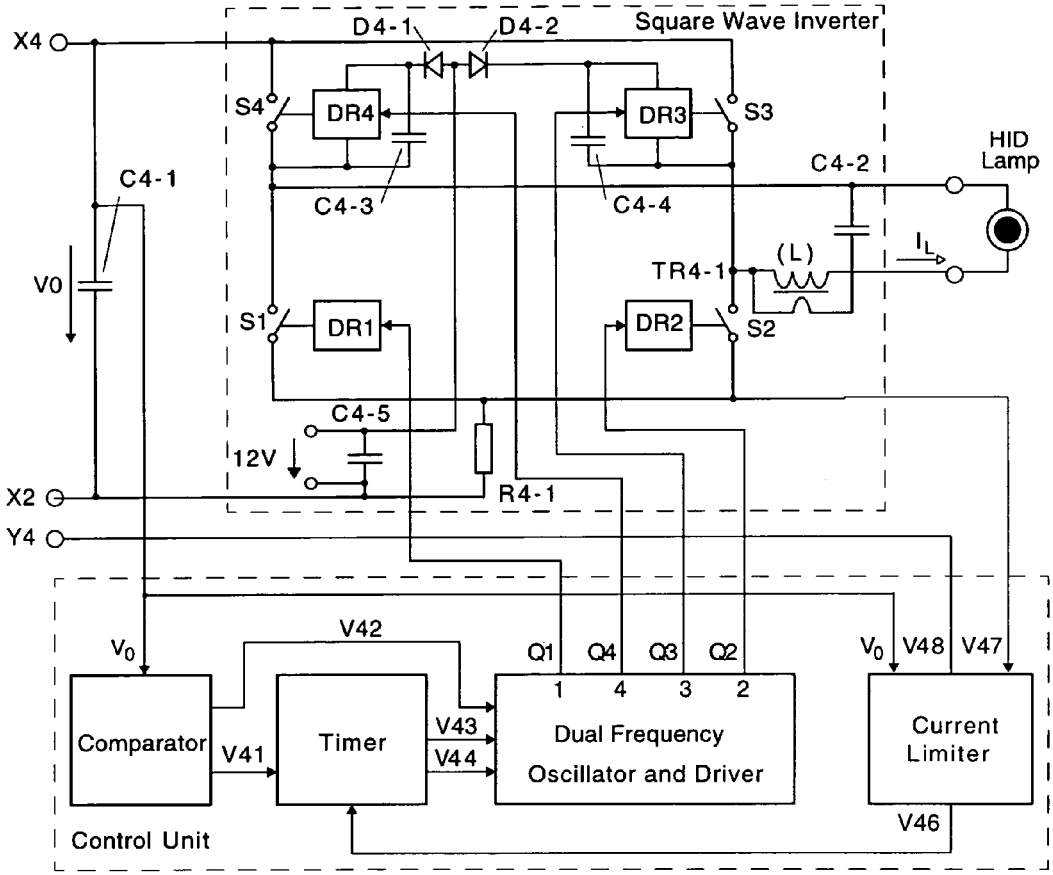
FIG. 4A shows the circuit diagram of a Square Wave Inverter designated as the Output Unit in FIG. 1A and its Control Unit.

HID lamps are usually supplied (avoiding cataphoretic phenomenon) with symmetrical AC current. Therefore, a symmetrical (D=50%) square wave inverter should be connected to the DC current source including high voltage ignitor circuit. Since the nominal frequency of the inverter is low (50 Hz-500 Hz), only the full-bridge configuration can be considered as it is shown in FIG. 4A including a Square Wave Inverter and its Control Unit. The inverter should also operate at high frequency for limited time (≈4s) periodically when the lamp start-up requires increased voltage.

Therefore, the application of MOSFET's are recommended as the main switches (S1, S2, S3 and S4), requiring appropriate drivers (DR1, DR2, DR3 and DR4). The supply voltages are boosted by rectifiers D4-1 and D4-2 to capacitors C4-3 and C4-4 respectively, wherein their cathodes are connected to capacitor C4-5 charged by 12V Logic Supply. For instance, C4-3 is charged when S1 is switched on. For ignition purposes, a small pulse transformer TR4-1 is connected in series with lamp. At low frequency, the effect of the transformer can be neglected except for a short time at switching points. The high frequency harmonic components of the lamp current is much lower than at high frequency operation. It follows that the instantaneous power is constant, similarly to the DC operation, except at the switching points, where it goes to zero in a short time interval (≈15 μs). The inductance of the secondary side of the ignition transformer TR4-1 can be utilized for short circuit protection. In this case the peak current can be controlled by a simple circuit, as the current is converted to a proportional voltage signal by resistor Rs.

Figure 4B:
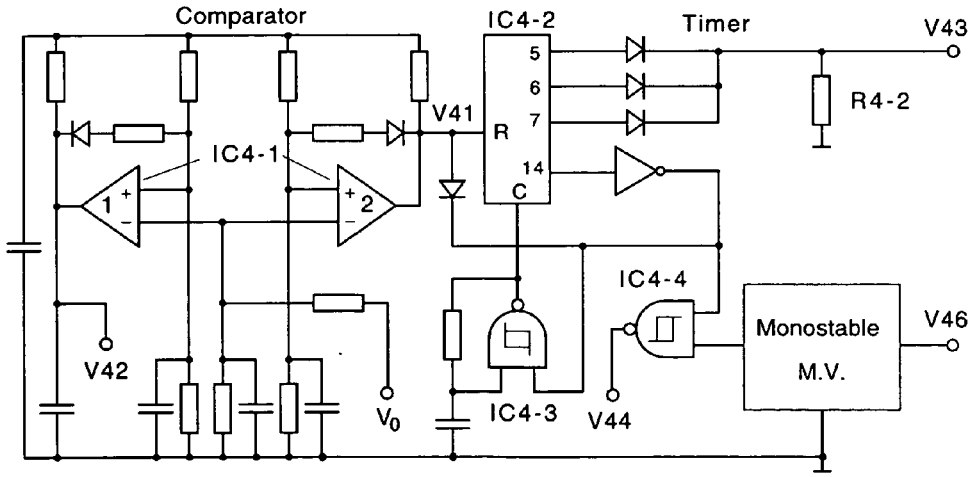
FIG. 4B shows the detailed circuit diagram of the Timer/Comparator subunit of the preferred Control Unit of the Square Wave Inverter.

(A) Timer and Comparator. The maximum output voltage range is determined by the current source ($0<V_0<200V$). Inside this range the load (lamp) determines the output voltage. When the voltage of an aging lamp achieves approximately 160V, the lamp should be switched off after a certain time delay (12 min.). Furthermore, there should be another (≈170V) voltage level, where the output unit start to operate at high frequency providing sufficiently high ignition voltage for the lamp. Sensing of these two voltage level and converting into digital signals, based on a dual comparator IC4-1 (controlled by $V_0$); is implemented by the Comparator unit shown in FIG. 4B. If $V_0<160V$, V41=V42=12V. When $V_0>160V$, the signal V41=0, and when $V_0>170V$, the signal V42=0. The Timer unit, controlled by signal V41, is also shown in FIG. 4B, including a ripple counter (IC4-2) connected to a simple oscillator based on the Schmitt-trigger IC4-3, a dual input AND-gate IC4-4, and a monostable multivibrator controlled by signal V46. The inverted output 14 of the ripple counter IC4-2 and the output of the monostable multivibrator are AND-gated resulting signal V44. After a predetermined time (approximately. 12 min.), the output signal V44 becomes zero, therefore the inverter will be stopped (see FIG. 4C). Selected outputs of the ripple counter (in our case 5, 6, and 7) are OR-gated to resistor R4-2 providing the output signal V43. As we shall see, the frequency (high or low) of the full-bridge inverter (therefore, the lamp current) is controlled by V43.

With respect to the output voltage $V_0$, the operation of the Output Unit can be summarized as follows:

1. $V_0<160V \rightarrow$Low frequency operation;
2. $160V<V_0<170V \rightarrow$Low frequency operation, Timer starts;
3. $V_0>170V \rightarrow$High frequency operation.

As we shall see later, when the output voltage decreases to a certain low value (<10V), indicating short circuit, within a short time the Output Unit and the Current Source will be switched off (see Current Limiter) implementing special short circuit protection for the ballast.

Figure 4C:
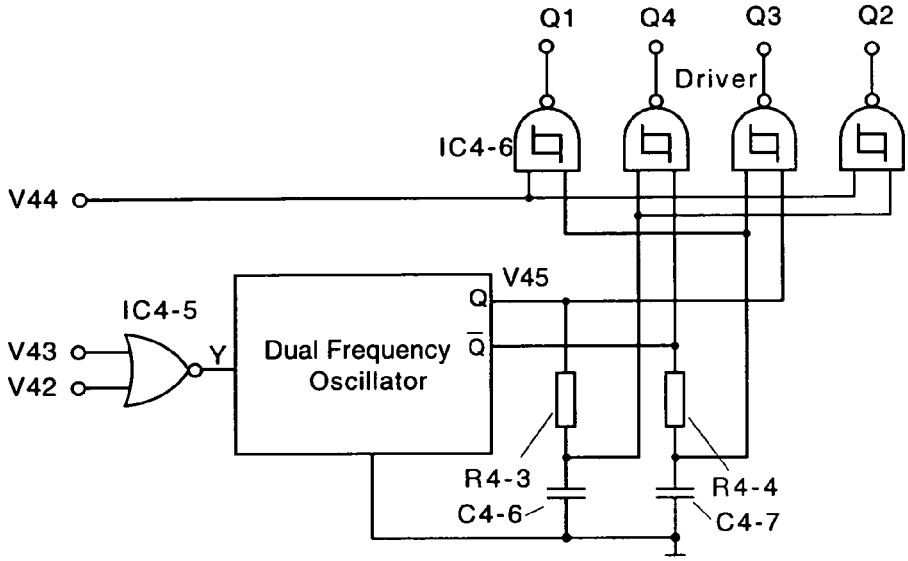
FIG. 4C shows the detailed circuit diagram of the Logic Driver/Oscillator subunit of the preferred Control Unit of the Square Wave Inverter.

(B) Dual Frequency Oscillator and Driver. The Dual Frequency Oscillator, shown in FIG. 4C, provides symmetrical square wave voltage signal V45 (see output Q). The high frequency (HF) or low frequency (LF) operation of the Dual Frequency Oscillator is controlled by signal Y, where $$Y = \overline{V42 + V43} = \begin{cases} 1 \rightarrow \text{HF operation} \\ 0 \rightarrow LF \text{ operation} \end{cases}$$

Figure 4D:
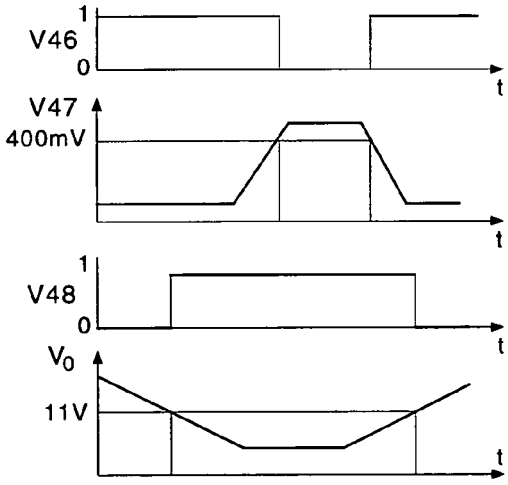
FIG. 4D shows the basic wave forms of the Current Limiter subunit of the preferred Control Unit of the Square Wave Inverter.
Figure 4E:
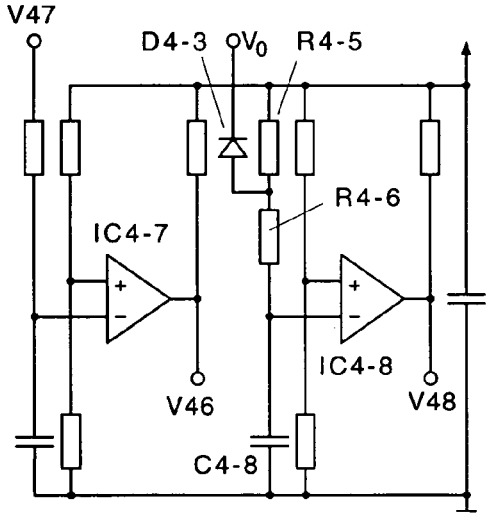
FIG. 4E shows the detailed circuit diagram of the Current Limiter subunit of the preferred Control Unit of the Square Wave Inverter.

In practice, the low frequency range can be 50 Hz-200 Hz. Lower then 50 Hz can cause flickering as the cataphoretic phenomenon starts to occur. The high frequency range can start at 20 KHz. Essentially higher frequency is not recommended because the increased switching losses. Since the inverter also operates at high frequency as the lamp needs increased voltage at start up, relatively powerful MOSFET drivers should be applied. The MOSFET derivers (DR1, DR2, DR3 and DR4) are controlled by driver signals Q1, Q2, Q3 and Q4, provided by the Driver subunit is also shown in FIG. 4C. The Driver includes a quad, dual input AND gate IC4-6. The upper MOSFET drivers DR3 and DR4 should include optoisolators having relatively long delay times (>1 μs). Therefore, avoiding the cross conductions of the main switches (S1-S4, S2-S3), the driver signals Q3 and Q4 should be delayed according to Q2 and Q1. The delay time (2 μs-5 μs) for the upper switch S3 (signal Q3) can be adjusted by R4-3 and C4-6 as it is shown in FIG. 4C. Similarly, the delay time (2 μs-5 μs)for upper switch S4 (signal Q4) can be adjusted by R4-4 and C4-7 as it is also shown in FIG. 4C (C) Current Limiter. The Current Limiter unit, shown in FIG. 4E, includes the low voltage comparators IC4-12 and IC4-13, where the inverting input of IC4-12 is connected to the current sensing resistor Rs shown in FIG. 4A. The inverting input of comparator IC4-7 is connected to the output of the Current Source ($V_0$). The resistors R4-5, R4-6 and capacitor C4-8 are connected in series, where the common point of resistor R4-6 and capacitor C4-8 is connected to the inverting input of IC4-8. Because of rectifier D4-3 connected to the common point of resistor R4-5 and R4-6, the voltage on the inverting input is effected by the output voltage $V_0$ if it is lower then approximately 11V. The corresponding signal wave forms are shown in FIG. 4D. If the output current increases above a certain level, than V46=0, and the monostable circuit of Timer unit will be triggered implementing peak current limitation. When the output voltage $V_0$, depending on the load impedance, decreases bellow approximately 11V, the output V48 goes to 1 and Current Source switches off, implementing short circuit protection. The main advantage of this solution that the actual short circuit operation exists only for a short time and the ballast is switched off until the short circuit condition exists (nearly zero output impedance).

Figure 4F:
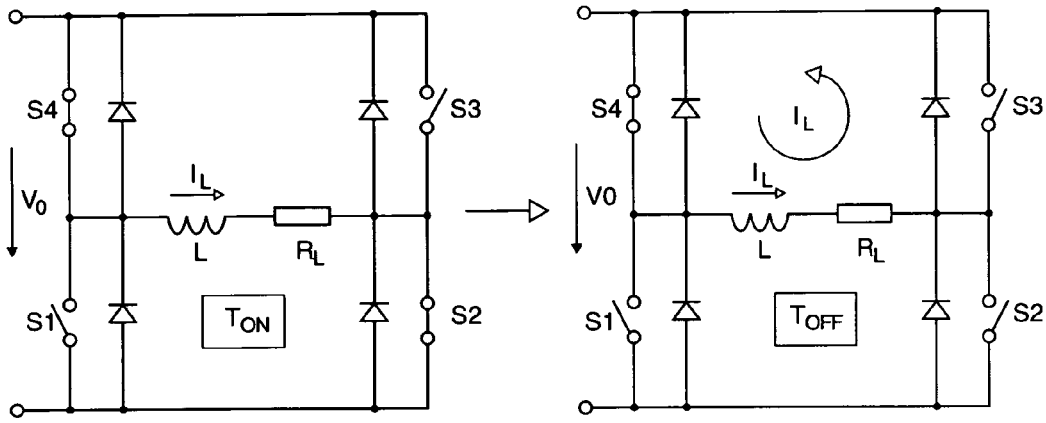
FIG. 4F illustrates the HF to LF transition from circuit topological view.
Figure 4G:
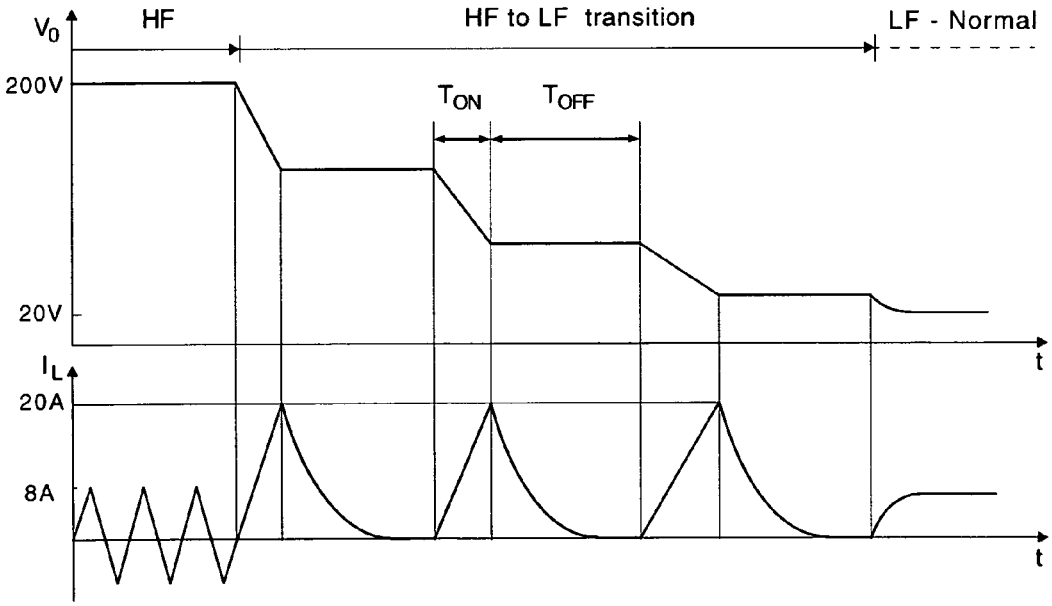
FIG. 4G shows the basic current and voltage wave forms with respect to the high frequency (HF) to low frequency (LF) transition.

FIG. 4F and FIG. 4G show a detailed illustration of the transition process from high frequency to low frequency operation and the short circuit protection. As it was previously described the Current Limiter unit switches off both the lower switches of the inverter and the Current Source for a certain predetermined time if the current reaches a certain level, for instance 20A. This way the maximum peak current in the MOSFET's can be limited to a safe level, even at increased temperature.

Thus, while preferred embodiments of the present invention have been shown and described in detail, it is to be understood that such adaptations and modifications as occur to those skilled in the art may be employed without departing from the spirit and scope of the invention, as set forth in the claims.

I claim:

1. A low frequency square wave electronic ballast for high intensity discharge lamps, comprising:

an input filter connected to a sinusoidal line voltage source as an external power supply, a bridge rectifier connected to the input filter, a filtered voltage divider connected to the output of the bridge rectifier providing a DC voltage signal proportional to the average of the rectified sinusoidal line voltage, an isolated dimming control unit including a low power external switch and an optocoupler providing isolated two-state control signal, a power factor preregulator connected to the output of said bridge rectifier including a control unit and a boost converter providing sinusoidal input current in phase with the line voltage, and further providing regulated DC output voltage, a constant power DC current source including a buck converter integrated with a nonlinear function generator, a voltage comparator, and a dimming circuit implementing the ideal full power or dimmed ballast curves for high intensity discharge lamps in their typical lamp voltage range, an output unit including a full-bridge inverter providing low frequency square wave current avoiding cataphoretic phenomenon of high intensity discharge lamps, a dual frequency driver unit of the full-bridge inverter, a high frequency to low frequency transition unit, a short circuit protection unit, and further including a high frequency ignition circuit providing appropriate ignition signal for high intensity discharge lamps, a logic supply voltage unit connected to the output of said bridge rectifier providing a first isolated and stabilized logic supply for the isolated dimming control unit, a second isolated and stabilized logic supply for the power factor preregulator, a third isolated and stabilized logic supply for the constant power DC current source, and a fourth isolated and stabilized logic supply for the output unit; wherein the output of the said power factor preregulator is connected to the input of the said constant power current source, and the output of the said constant power current source is connected to the input of the said output unit, and the output of the said output unit is connected to a high intensity discharge lamp implementing a low frequency square wave electronic ballast providing an acoustic resonance free operation of the lamp; and further wherein the output of the said filtered voltage divider is connected to the control unit of said power factor preregulator, and the control unit of said power factor preregulator is connected to the control unit of said constant power DC current source providing automatic dimming of the high intensity discharge lamp if the line voltage is out of its predetermined range; and still further wherein the optocoupler of the said isolated dimming control unit is connected to the control unit of said power factor preregulator and the dimming circuit of the constant power DC current source providing an isoiated external dimming control of the high intensity discharge lamp.

2. The boost converter in accordance with claim 1, comprising an inductor, a controlled electronic switch, an output capacitor, and a first rectifier implementing the standard boost converter configuration operating in continuous-discontinuous border mode, and further comprising a second rectifier; wherein the anode of second rectifier is connected to the lower potential end of controlled electronic switch, the cathode of second rectifier is connected to the lower potential end of output capacitor, and the cathode of second rectifier is connected to the said control unit of power factor preregulator providing a stable and noise free signal for the said control unit of power factor preregulator when the current of the inductor decreases to zero value.

3. The control unit of power factor preregulator in accordance with claim 1, comprising a first resistor, a capacitor, an analog controller, a voltage comparator, and a first low power MOSFET implementing the standard constant ON-time control of said boost converter, and further comprising a window comparator, a second resistor, and a second low power MOSFIT; wherein the input of the window comparator is connected to the output of said filtered voltage divider, the output of the window comparator and the output of the said optocoupler is connected to the gate of the second low power MOSFET, the second resistor is connected to the drain of the second low power MOSFET, the source of the second low power MOSFET is connected to said first stabilized logic supply and to the common point of the first resistor and capacitor providing transient free transition of the power factor preregulator between the full power and dimmed operation.

4. The buck converter integrated with a nonlinear function generator in accordance with claim 1, comprising an inductor, a controlled electronic switch, an output capacitor, and a first rectifier implementing the standard buck converter configuration operating in continuous-dis-continuous border mode, and further comprising a second rectifier and a second capacitor; wherein the anode of die second rectifier is connected to the output capacitor, the cathode of the second rectifier is connected to an end of second capacitor, and the other end of the second capacitor is connected to the cathode of the first rectifier, therefore bootstrapping the output voltage of the buck converter to the potential level of the common point of the controlled electronic switch, the first rectifier and the zero level of said third stabilized logic supply voltage source, and still further comprising a third rectifier, a first resistor, a second resistor, a third resistor, and a fourth resistor; wherein the first end of the first resistor is connected to the first end of the second and the third resistor, the second end of the second resistor is connected to the anode of the third rectifier, the cathode of the third rectifier is connected to said third stabilized logic supply voltage source, the second end of the third resistor is connected to the first end of the fourth resistor, the second end of the fourth resistor is connected to the zero level of said third stabilized logic supply voltage source, and the common point of the third and the fourth resistor is connected to the inverting input of said voltage comparator providing a nonlinear conversion of the output voltage of the buck converter equal to the voltage of said high intensity discharge lamp in such a way that the lamp power remains the same in their typical lamp voltage range.

5. The dimming circuit in accordance with claim 1, comprising a low power MOSFET and a capacitor; wherein the source of the low power MOSFET is connected to the first end of the capacitor, the drain of the low power MOSFET is connected to said third stabilized logic supply voltage source, the gate of the low power MOSFET is controlled by said optocoupler of the isolated dimming control unit, and the second end of the capacitor is connected to the non-inverting input of said voltage comparator providing dimming control of the said constant power DC current source, therefore the dimming of said high intensity discharge lamp.

6. The full-bridge inverter in accordance with claim 1, comprising a first power MOSFET connected to first MOSFET driver, a second power MOSFET connected to second MOSFIT driver, a third power MOSFET connected to a third MOSFET driver, a fourth power MOSFET connected to a fourth MOSFET driver implementing the standard full-bridge inverter; wherein the first and the second power MOSFET's are lower electronically controlled switches, the third and the fourth power MOSFET's are the upper electronically controlled switches of the full-bridge inverter, and further comprising a first rectifier, a second rectifier, a first capacitor connected to said fourth MOSFET driver, and a second capacitor connected to said third MOSFET driver; wherein the cathode of the first rectifier is connected to the first capacitor, the cathode of the second rectifier is connected to the second capacitor, and the anodes of the first and the second rectifiers is connected to said fourth stabilized voltage source, and the zero potential level of the said fourth stabilized voltage source is connected to the common point of the sources of the first and the second power MOSFET's providing logic supply voltage source for the third and the fourth MOSFET drivers during the high and the low frequency operation of the full-bridge inverter, therefore eliminating two extra isolated stabilized logic supplies for said output unit.

7. The high frequency to low frequency transition unit in accordance with claim 1, comprising a shunt resistor, a reference voltage source, a voltage comparator, a monostable multivibrator; wherein the shunt resistor is connected in series with the full-bridge inverter, the common point of the shunt resistor and the full-bridge inverter is connected to the inverting input of the voltage comparator, the non-inverting input of the voltage comparator is connected to the reference voltage source, the output of the voltage comparator is connected to the input of the monostable multivibrator, and the output of the said voltage comparator is connected to said dual frequency driver unit of the full-bridge inverter providing a series of inhibition signals for the full-bridge inverter during the transition process from high frequency to low frequency operation of the full-bridge inverter when the load current across the shunt resistor achieves a predetermined value proportional to the reference voltage.

8. The short circuit protection unit in accordance with claim 1, comprising a voltage comparator, a rectifier, a capacitor, a first resistor, a second resistor, a third resistor, and a fourth resistor; wherein the first and the second resistor implement a voltage divider connected to said fourth stabilized logic supply voltage source, the common point of the first and the second resistors is connected to the inverting input of the voltage comparator, the third and the fourth resistor and the capacitor are connected in series and their two ends are connected to forth said stabilized logic supply voltage source, the common point of the fourth resistor and the capacitor is connected to the non-inverting input of voltage comparator, the common point of the third and the fourth resistors is connected to the anode of the rectifier, the cathode of the rectifier is connected to the input of said output unit, and the output of the voltage comparator inhibits the said constant power DC current source providing zero current short circuit protection for said output unit.

9. The high frequency ignition circuit in accordance with claim 1, comprising a transformer having a primary and a secondary winding, and further comprising a capacitor; wherein the primary winding of the transformer is connected in series with the capacitor, and further connected to the output of said full-bridge inverter, the secondary winding of the transformer is connected in series with said high intensity discharge lamp providing high frequency and an appropriate high voltage sinusoidal ignition signal for said high intensity discharge lamp during the high frequency operation of the said full-bridge inverter.

* * * * *